US006615828B1

(12) United States Patent
Petherbridge

(10) Patent No.: US 6,615,828 B1
(45) Date of Patent: Sep. 9, 2003

(54) FLOW INDICATOR DEVICE FOR RESPIRATORS

(75) Inventor: Ian T. Petherbridge, West Sussex (GB)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/531,839

(22) Filed: Mar. 20, 2000

(30) Foreign Application Priority Data

Mar. 19, 1999 (GB) ..... 9906322

(51) Int. Cl.[7] ..... A62B 29/00

(52) U.S. Cl. ..... 128/200.28; 128/200.27; 128/202.22

(58) Field of Search ..... 128/200.27, 200.28, 128/202.22, 205.25

(56) References Cited

U.S. PATENT DOCUMENTS

| | | | | | |
|---|---|---|---|---|---|
| 2,332,662 | A | * | 10/1943 | Nathanson | 128/200.27 |
| 2,469,273 | A | * | 5/1949 | Parker | 128/205.25 |
| 2,507,705 | A | * | 5/1950 | Gaddini | 128/205.25 |
| 2,764,152 | A | * | 9/1956 | Osterberg | 128/205.25 |
| 3,478,740 | A | * | 11/1969 | Wennberg | 128/200.22 |
| 3,657,740 | A | * | 4/1972 | Cialone | 128/205.25 |
| 3,785,333 | A | * | 1/1974 | Warncke et al. | 128/202.22 |
| 4,133,308 | A | | 1/1979 | Lowe et al. | 128/200.28 |
| 4,136,688 | A | | 1/1979 | Gorman | 128/200.28 |
| 4,233,972 | A | * | 11/1980 | Hauff et al. | 128/200.28 |
| 4,280,491 | A | | 7/1981 | Berg et al. | 128/201.24 |
| 4,287,886 | A | | 9/1981 | Thompson | 128/202.22 |
| 4,343,194 | A | | 8/1982 | Dehart et al. | 73/861.65 |
| 4,372,170 | A | | 2/1983 | Dehart et al. | 73/861.61 |
| 4,462,399 | A | | 7/1984 | Braun | 128/201.25 |
| 4,476,729 | A | | 10/1984 | Stables et al. | 73/861.61 |
| 4,765,326 | A | | 8/1988 | Pieper | 128/202.22 |
| 4,884,460 | A | | 12/1989 | Nowacki et al. | 73/861.52 |
| 5,046,492 | A | * | 9/1991 | Stackhouse et al. | 128/200.27 |
| 5,048,516 | A | * | 9/1991 | Soderberg | 128/200.27 |
| 5,676,132 | A | | 10/1997 | Tillotson et al. | 128/204.23 |
| 5,832,916 | A | * | 11/1998 | Lundberg | 128/201.28 |
| 5,950,621 | A | * | 9/1999 | Klockseth et al. | 128/202.22 |

FOREIGN PATENT DOCUMENTS

| | | |
|---|---|---|
| DE | 3032371 A1 | 3/1982 |
| DE | 197 00 229 A1 | 11/1997 |
| EP | 0 349 191 B1 | 10/1993 |
| EP | 0 602 847 A1 | 6/1994 |
| FR | 594676 | 3/1925 |
| GB | 2032284 A | 5/1980 |
| GB | 2130893 A | 6/1984 |
| GB | 2225958 | 12/1989 |

* cited by examiner

*Primary Examiner*—Aaron J. Lewis
(74) *Attorney, Agent, or Firm*—Karl G. Hanson

(57) ABSTRACT

A respirator that comprises a head piece (1) that is shaped to form a breathing zone (13) around at least the nose and mouth of the wearer, and an air flow passage (15, 34) for supplying a forced flow of air to the breathing zone. The air flow passage has a constricted portion (46) that includes a flow detecting orifice (52). The forced flow of air generates suction at the flow-detecting orifice. A pressure-responsive indicator device (30) is in fluid communication with the flow-detecting orifice through a tube (54) and is operable to alert the wearer if the suction generated by the air flow through the passage falls below a predetermined value.

11 Claims, 6 Drawing Sheets

FLOW INDICATOR DEVICE FOR RESPIRATORS

This application claims priority from United Kingdom Serial No. 9906322.4 filed Mar. 19, 1999.

BACKGROUND

The present invention pertains to a respirator that provides a forced flow of filtered air to the wearer and that can alert the wearer when suction generated by the air flow falls below a predetermined value.

One of the common purposes of a respirator is to prevent contaminants from entering a wearer's respiratory system. A respirator typically comprises a head piece that is shaped to form a breathing zone around at least the nose and mouth of the wearer. In some respirators, the wearer's breathing action causes air to be drawn into the breathing zone through a filter. Other respirators, however, provide a forced flow of filtered air to the breathing zone to relieve the wearer of the need to inhale against the resistance of a filter and to ensure that any leakage in the respirator is outwards—that is, away from the breathing zone rather than into it.

Respirators that use a forced flow are preferred in certain working environments, particularly those that are physically demanding on the wearer and those where the wearer is likely to benefit from the cooling effect of air flowing through the breathing zone.

A forced flow of air into the breathing zone of a respirator may be generated by a fan or by a blower which, together with its power source, may be carried by the respirator wearer. This kind of system is known as a powered air system. Alternatively, the forced flow of air may be obtained from a source of compressed air, which may be either fixed or portable. A system that uses compressed air is commonly known as a supplied air system.

Examples of respirators that provide a forced flow of filtered air to the wearer are described in U.S. Pat. Nos. 4,133,308, 4,136,688, 4,280,491 and 4,462,399, and in GB-A 2,032,284. Forced flow respirators can have an indicator device that is capable of warning the wearer when air flow into the breathing zone falls below a safe level. Regulations are increasingly being introduced to make these indicator devices compulsory; see, for example, the new European standard EN 12941. Examples of indicator devices that have previously been proposed are described in DE-A-30 32 371, GB-A 2,130,893, U.S. Pat. No. 4,765,326, and in EP-A-0 349 191 and 0 602 847. It nevertheless remains desirable to provide an indicator device that will not add substantially to the cost of a respirator and that will function reliably without substantially affecting the forced air flow into the respirator breathing zone.

SUMMARY OF THE INVENTION

The present invention provides a respirator that provides a forced flow of filtered air to a wearer, the respirator comprises:

- a head piece that is shaped to form a breathing zone around at least the nose and mouth of the wearer;
- an air flow passage that carries a forced flow of air to the breathing zone, the passage having a constricted portion that contains a flow detecting orifice such that the forced flow of air generates suction at the flow-detecting orifice, the degree of suction being related to the air flow rate in the passage; and
- a pressure-responsive indicator device that is in fluid communication with the flow-detecting orifice and that is operable to alert the wearer if the suction generated by the air flow through the passage falls below a predetermined value.

As used herein, the term "air" includes breathable gases.

BRIEF DESCRIPTION OF THE DRAWINGS

By way of example only, embodiments of the invention are described with reference to the accompanying drawings, in which.

DETAILED DESCRIPTIONS OF PREFERRED EMBODIMENTS

In describing preferred embodiments of the invention, specific terminology is used for the sake of clarity. The invention, however, is not intended to be limited to the specific terms so selected, and each term so selected includes all technical equivalents that operate similarly.

Figure 1:
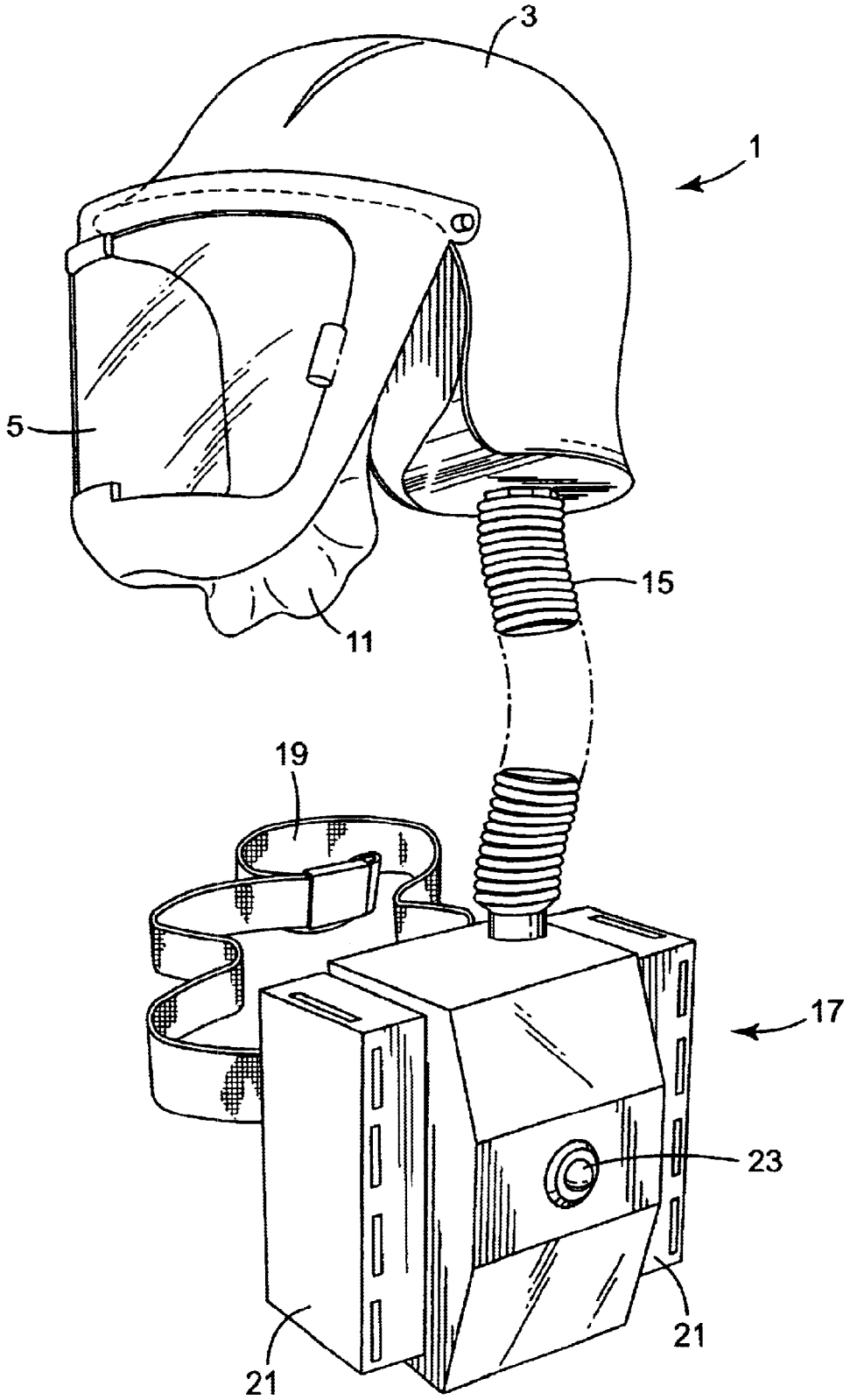
FIG. 1 is a perspective view of a respirator in accordance with the invention.

The respirator shown in FIG. 1 includes a head piece in the form of a helmet 1. The helmet 1 comprises (i) a shell 3 that is intended to extend over the top, back, and sides of the head of the respirator wearer, and (ii) a visor 5 that extends downwards from the front of the shell.

Figure 2:
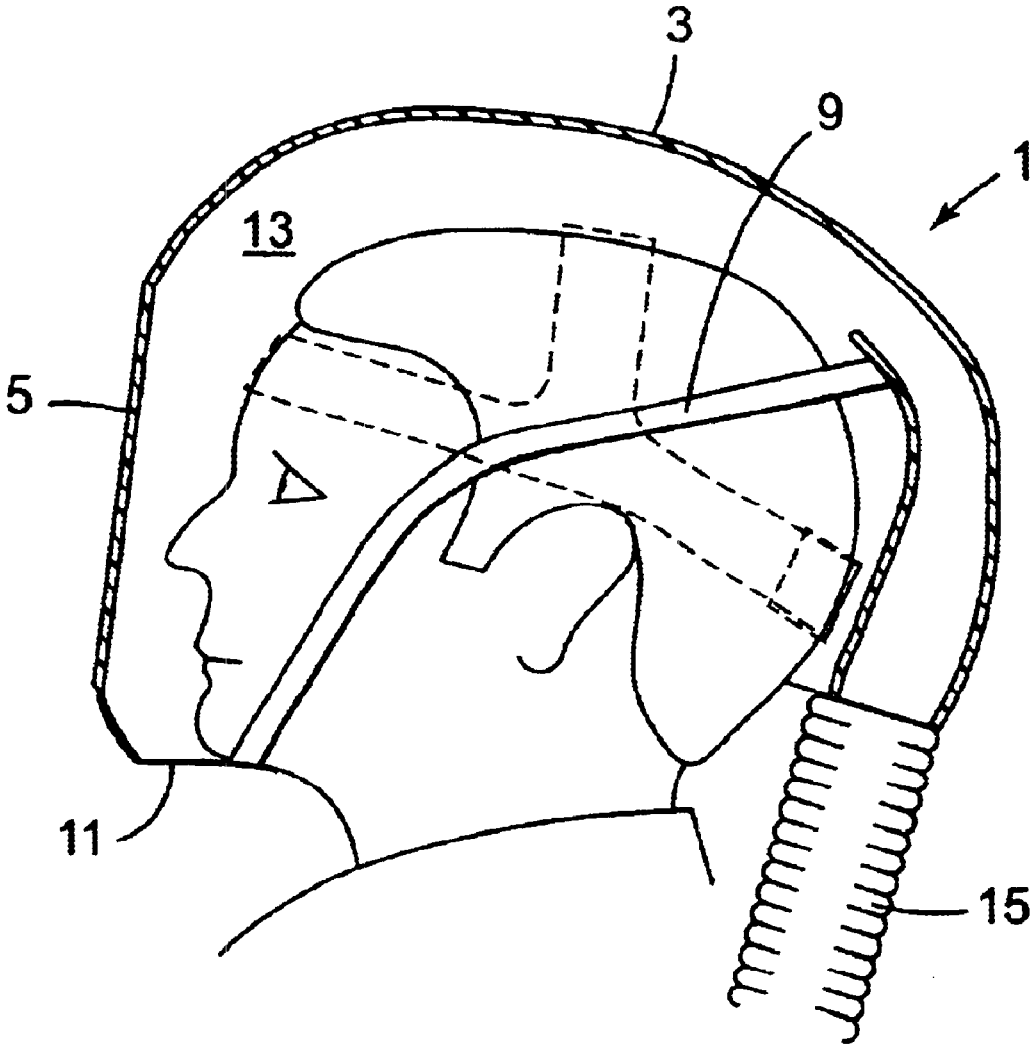
FIG. 2 is a diagrammatic sectional view of the head piece of the respirator of FIG. 1 with certain components omitted, the head piece being shown positioned on the head of a wearer.

As shown in FIG. 2, the shell 3 is supported on the wearer's head by a harness 7. A seal 9 is provided to seal the gap between the shell 3 and the wearer's head, and a flexible membrane 11 extends from the lower edge of the visor 5 to bear against the wearer's chin and close the bottom of the helmet. The helmet 1 thus defines a substantially closed breathing zone 13 that is disposed around part of the wearer's head, particularly the breathing passages of the nose and mouth.

A flexible hose 15 extends from the rear of the helmet 1 to connect the interior of the helmet to a power pack 17 that is supported on a belt 19 so that it can be carried at the wearer's waist. The power pack 17 contains a fan (not visible), a battery-powered DC motor (also not visible) for driving the fan, and filter cartridges 21 through which air is drawn by the fan for delivery into the hose 15 and then into the interior of the helmet 1. A control knob 23 for the DC motor is located on the outside of the power pack 17, where it is readily accessible by the respirator wearer. The filter cartridges 21 are replaceable and may be designed to remove dust and/or noxious gases from the air, depending on the environment in which the respirator is to be used.

When the respirator is in use as shown in FIG. 2, filtered air from the power pack 17 (FIG. 1) is delivered into the chamber 13 around the wearer's head and is inhaled by the wearer. Surplus filtered air and exhaled air leave the chamber 13 by natural leakage at the seals 9, 11 or through vents that are formed in the helmet 1 adjacent the wearer's mouth specifically for that purpose. In some cases, a one-way outlet valve is provided in the helmet adjacent the wearer's mouth to provide a route by which surplus filtered air and exhaled air can leave the chamber 13. The rate at which surplus filtered air and exhaled air leave the helmet typically causes a slight positive pressure (of about 2 to 4 Pa) to build up within the chamber 13.

Figure 3:
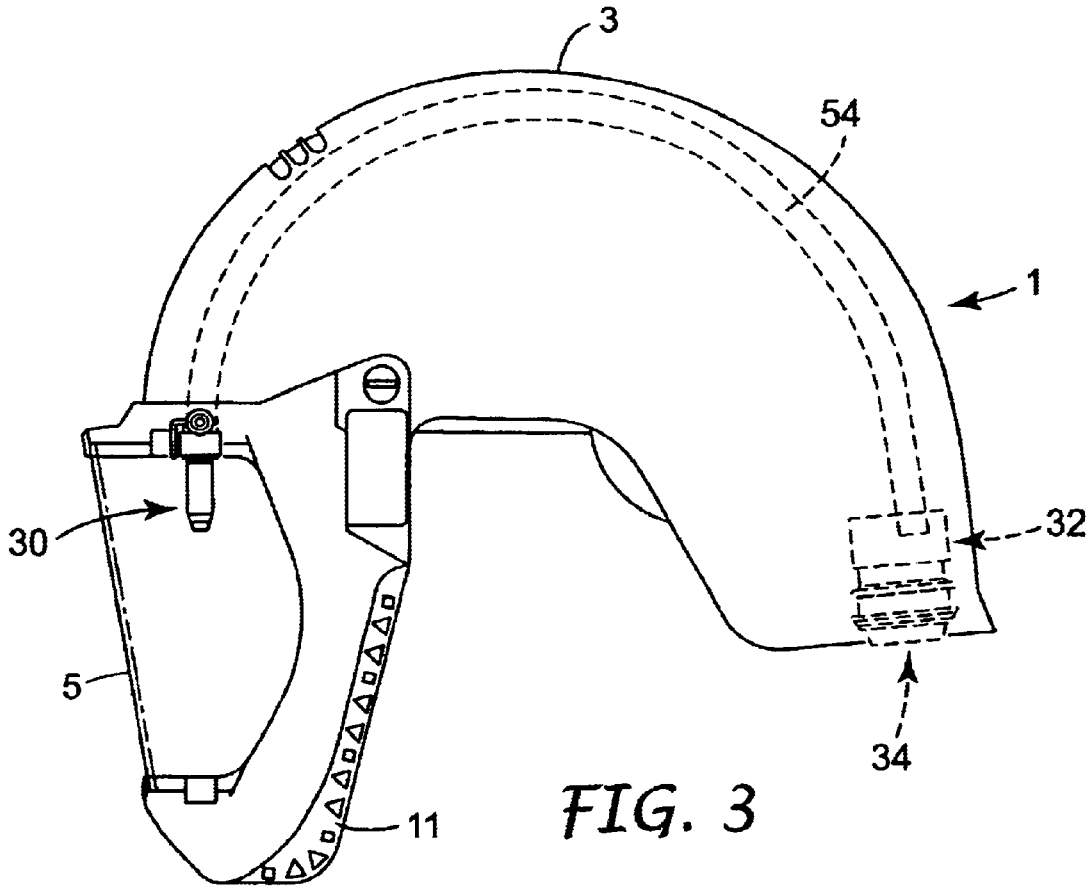
FIG. 3 is a side view of the head piece of the respirator of FIG. 1, with certain internal components being indicated by dotted lines.

As shown in FIG. 3, an indicator device 30 can be provided within the helmet 1, adjacent the visor 5, to warn the wearer whenever the rate of flow of filtered air into the helmet falls below a predetermined level. To enable that flow rate to be detected, a venturi device 32 is provided within the helmet 1 at the air inlet from the hose 15. The venturi device 32 is a generally cylindrically-molded component that is shaped externally at its inlet end 34 for attachment to the end of the hose 15, preferably by means of a quick-release connection that permits the hose to swivel relative to the helmet. Internally, the venturi device 32 can provide an air flow passage through which the filtered air supplied by the hose passes to the chamber 13 within the helmet, and also enables the air flow rate to be detected.

FIGS. 4 to 8 show the venturi device 32 in better detail, particularly FIGS. 5–8 where the internal construction of the venturi device 32 is shown. The external walls of the venturi device 32 define a main passage 36 of circular cross-section extending from the inlet end 34 of the device to the outlet end 38. Over the first part 40 of its length, the passage 36 is of substantially constant diameter but then widens out towards the outlet end 38. A smaller diameter tube or auxiliary venturi 42 is supported by integral diametric ribs 44, within the part 40 of the main passage 36 and is preferably, but not essentially, coaxial with the latter. The tube 42 and ribs 44 extend for the length of the part 40 of the main passage 36 and effectively constrict the latter so that, when the device 32 is attached to the end of the hose 15, the main passageway 36 forms a primary venturi that has part 40 as its throat. The tube 42 is also formed internally with the customary venturi shape (see FIG. 5) comprising a throat 46 of narrower cross section than the tube inlet 48 and outlet 50. The tube 42 thus constitutes an auxiliary venturi positioned within the primary venturi formed by the main passage 36.

Figure 4:
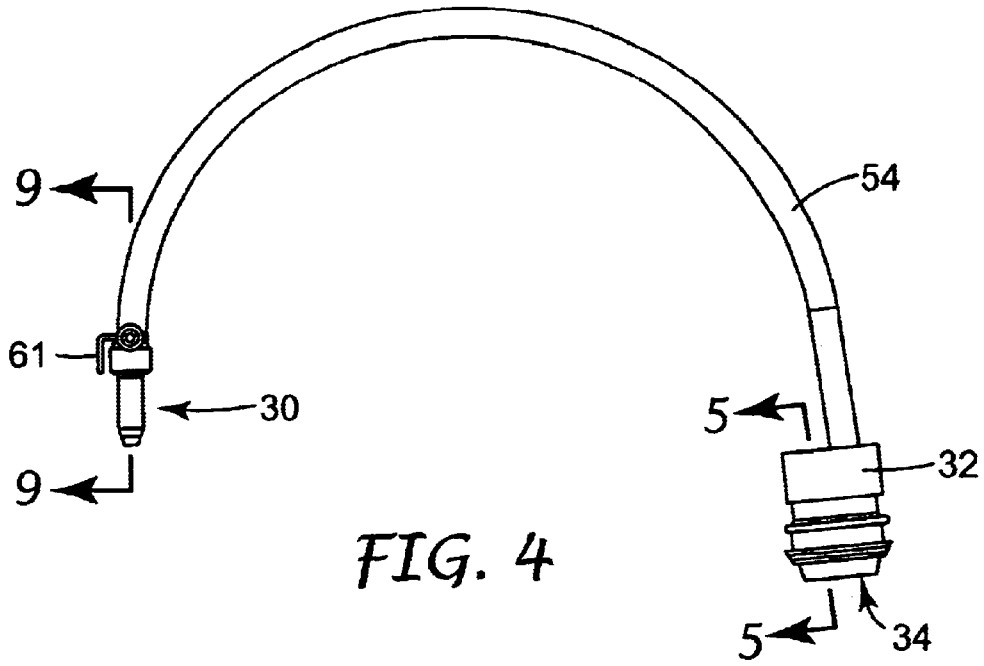
FIG. 4 shows the components that are indicated by dotted lines in FIG. 3.
Figure 6:
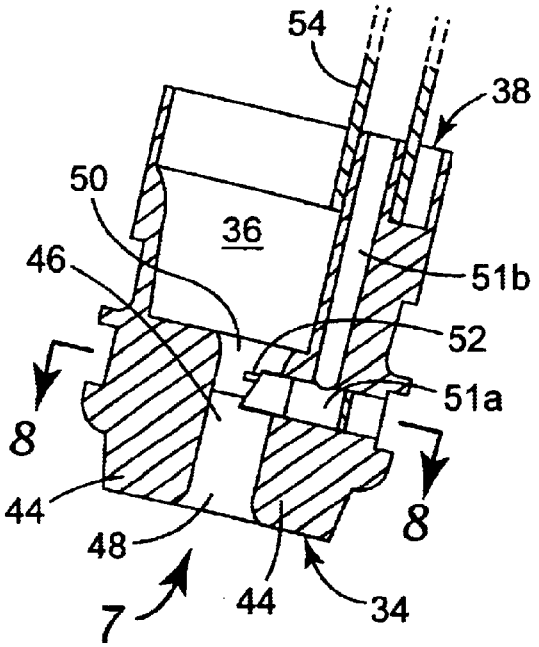
FIG. 6 is a cross-section taken on the line VI—VI in FIG. 5.
Figure 7:
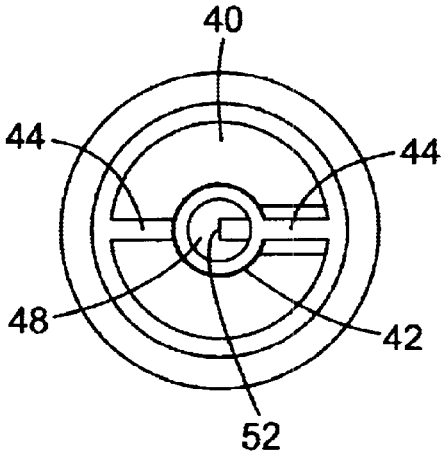
FIG. 7 is an end view in the direction of the arrow VII in FIG. 6.
Figure 8:
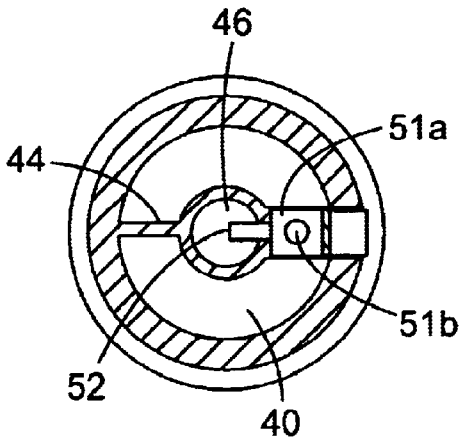
FIG. 8 is a cross-section taken on the line VIII—VIII in FIG. 6.

As shown in FIG. 6, a right-angle passage 51*a*, 51*b* extends from an orifice 52 on the longitudinal axis of the throat 46 of the auxiliary venturi 42 and into communication with a connector tube 54 that extends, inside the shell 3 of the helmet, to the indicator device 30. The tube 54 is curved as shown in FIG. 4 to follow the shape of the top of the helmet so that, when the helmet is in use, it extends over the top of the wearer's head. When the hose 15 is connected to the helmet 1, filtered air that is supplied from the power pack 17 (FIG. 1) enters the breathing zone 13 (FIG. 2) through the venturi device 32. A portion of the air passes into the auxiliary venturi 42 and, in so doing, generates suction at the orifice 52. The degree of suction is dependent on the air flow rate through the auxiliary venturi 42. The suction is applied, through the connector tube 54, to the indicator device 30 and is used to operate the latter as described below.

Figure 9:
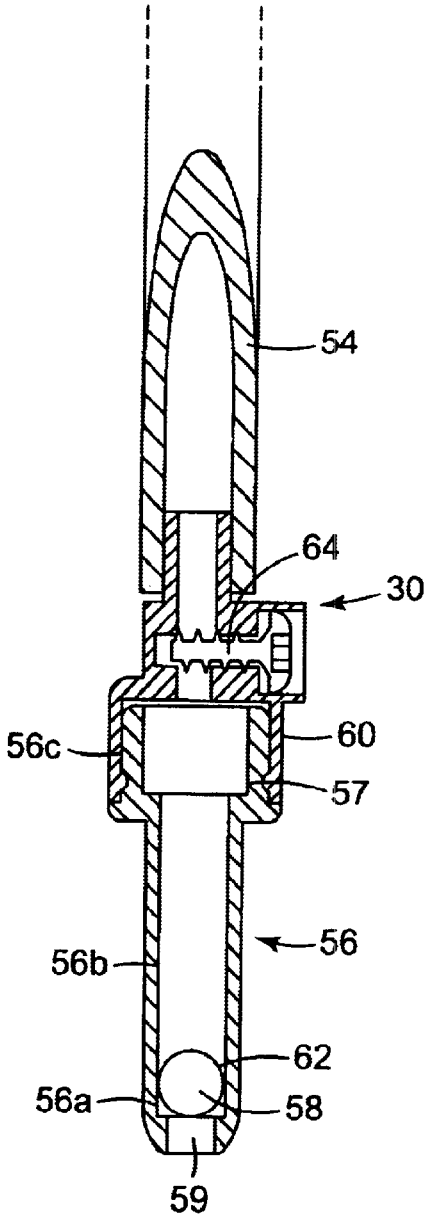
FIG. 9 is a cross-section taken on the line IX—IX in FIG. 4, shown enlarged, shown in FIG. 10 as VIII—VIII.

As shown in FIG. 9, the indicator device 30 may comprise an open-ended indicator tube 56 that is preferably formed from a transparent material and that contains a float in the form of an indicator ball 58 that is visible through the tube. The indicator tube 56 is widened out at one end 57 so that it can be located in a coupling member 60 by which it is attached to the end of the connector tube 54 from the venturi device 32. The coupling member 60 is opaque so that the indicator ball 58 cannot be seen when is located within this widened end of the indicator tube 56. The other end of the indicator tube 56 has a reduced opening 59 to the interior of the helmet 1, and a small step 62 is formed in the bore of the tube adjacent this opening 59, whereby the bore has three distinct sections 56*a*, 56*b* and 56*c* of successively increasing diameter in the direction away from the opening.

An adhesive-backed mounting flange 61 (FIG. 4) extends from the coupling member 60 and is used to attach the coupling member to a suitable location inside the helmet so that the indicator tube 56 is positioned vertically in the field of vision of the wearer, with the open end of the tube being lowermost. When the helmet 1 is not in use, the indicator ball 58 is located in the smaller-diameter section 56*a* of the bore of the tube 56 adjacent the opening 59, as shown in FIG. 9.

The indicator ball 58 is formed from a light material (for example, polystyrene) so that, when the helmet 1 is in use, suction applied through the coupling member 60 as a result of air flow through the venturi device 32 draws air in through the opening 59 and causes the ball to rise up inside the tube 56. The effect of the step 62 in the bore is that the ball 58 will tend to hover at the level of this step when the air flow through the venturi device 32 is low and will rise up into the widened end portion 57 when the air flow is at a normal safe level. In the latter location, the ball 58 is obscured by the coupling member 60 and is not visible to the wearer of the helmet. If the air flow through the venturi device 32 drops while the respirator is in use (for example because the filters 21 become blocked or the batteries in the power pack fail) the suction applied through the coupling member 60 will also fall and, depending on the magnitude of the reduction, may cause the indicator ball 58 to fall and hover once again at the level of the step 62 where it will be clearly visible to the wearer. An adjustment screw 64 extends through the coupling member 60 into the bore of the indicator tube 56 to enable the effect of the suction on the indicator ball 58 to be adjusted so that the latter descends from the end portion 57, and is visible to the wearer, only when the air flow through the venturi device 32 drops to an unsafe level. The provision of the adjustment screw 64 removes the need for the indicator ball 58 to be made accurately to a particular size, and also enables the indicator device 30 to be adjusted for different air flows through the venturi device 32.

The construction of the venturi device 32 shown in FIGS. 5 to 8 (in particular, the positioning of the auxiliary venturi 42 in the throat 40 of the primary venturi) has the effect of amplifying the suction effect generated at the orifice 52 by a particular air flow into the helmet 1 making it possible, if required, to use some other form of indicator device instead of the ball indicator 30. For example, the suction generated at the orifice 52 could be applied to a pressure responsive switch and use to actuate an electrically-operated warning device such as an LED. Alternatively, it could be used to generate a feedback signal for controlling operation of the motor that drives the fan in the power pack 17, whereby the speed of the motor is increased if the air flow into the helmet 1 falls. As a further alternative, a warning device that generates some other form of signal (for example an audible signal) instead of, or in addition to, a visual signal could be used. The particular form of the venturi device 32 described above is not essential, however, and it would be possible to use a simpler form comprising a single venturi only.

Figure 5:
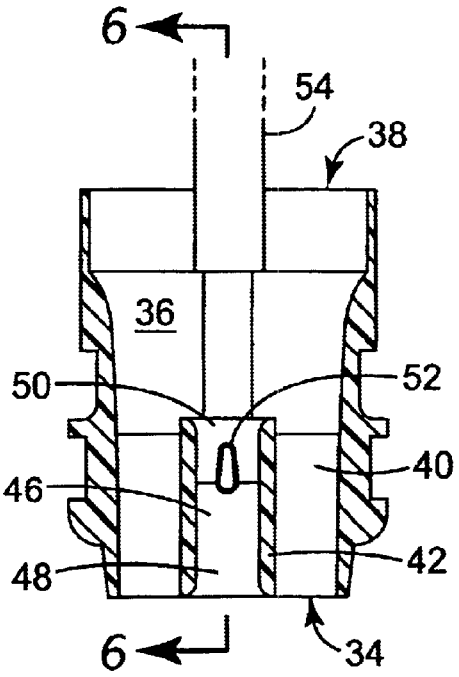
FIG. 5 is a cross-section taken on the line V—V in FIG. 4, shown enlarged.

An exemplary venturi device 32 of the type shown in FIGS. 5 and 6 has the following dimensions:

diameter of passage 36 at the inlet 34: 26 mm diameter of tube 42 at the inlet 34: 10 mm length of passage 36: 40 mm length of tube 42: 20 mm.

Using such a venturi device 32, it is possible to produce a pressure reduction, at the orifice 52, of the order of 13–14 Pascals (Pa) when the air flow rate through the device is 160 liters per minute (l/min), which is typical for a system of the type shown in FIG. 1. The total air flow generated by the power pack 17 is delivered to the breathing zone 13 of the respirator helmet 1, and the additional restriction created in the air flow path by the venturi device 32 is found to not have a significant impact on the operation of the system.

Indicator devices of the general type shown in FIG. 9 are known, and any suitable known or later developed form may be employed in combination with the venturi device 32. The form shown in FIG. 9 is advantageous, however, because the provision of the seat 62 at which the indicator ball 58 will hover even at very low air flows (of the order of 50 (l/min) reduces the risk of the ball sticking in the lower end of the indicator tube 56.

The location of the indicator device 30 can be changed, depending on the form of the device and the form of the respirator in which it is used. The device does not have to be positioned directly in front of the wearer's eyes, provided it is capable of attracting the wearer's attention when necessary. The indicator device 30 also does not have to be positioned inside the helmet 1, although that location does offer the advantage that air drawn into the indicator tube 54 is clean. The indicator device could, in fact, be in any location in which it is capable of issuing a warning when the air flow into the helmet is low.

The venturi device 32 also does not have to be located on the helmet 1. It could be located anywhere in the path of the forced air flow into the helmet, for example, at the outlet from the power pack 17.

The respirator shown in FIG. 1 is merely one example of a powered respirator in which the indicator 30 and flow-detecting venturi device 32 can be used. Many other forms of powered respirator are available. In some respirators, for example, the fan and air filter are located in the respirator helmet itself rather than at the wearer's waist in a separate power pack. The relative positions of the fan and filter are also interchangeable, regardless of where they are actually located (i.e. the fan may be upstream of the filter, rather than downstream as in the system of FIG. 1). It is also not essential that a fan be used to provide the forced flow of air for the respirator; for example, in some cases, a centrifugal blower may be used.

The headpiece of the respirator may also take other forms. For example, it may have the shape shown in FIG. 1 but may be provided, additionally, with a hard hat inside the shell 3, which fits around and further protects the head of the wearer. In another case, the headpiece may be required to provide only respiratory protection for the wearer. In that case, it may comprise simply a face mask or visor possibly with a hood to cover but without providing protection for, the head of the wearer.

Figure 10:
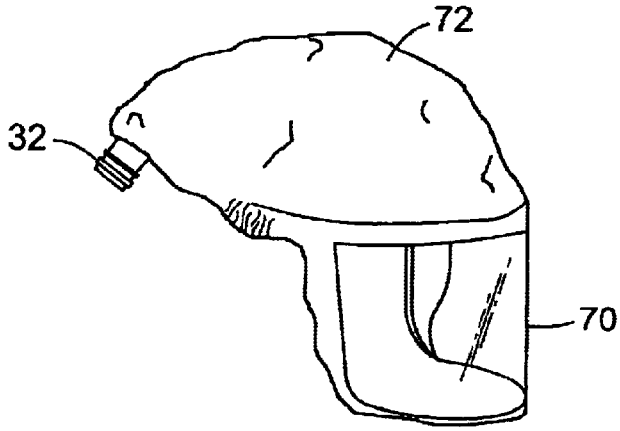
FIG. 10 is a perspective view of another respirator in accordance with the invention.
Figure 11:
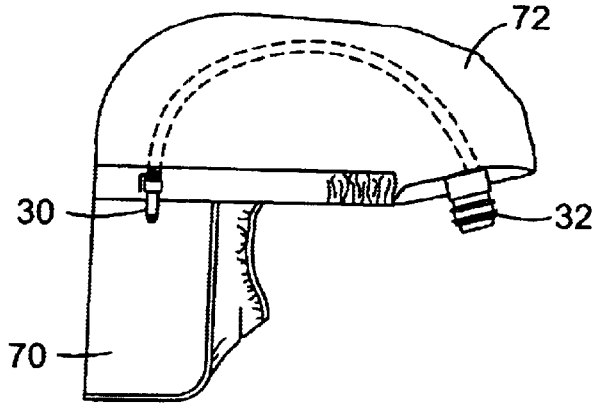
FIG. 11 is similar to FIG. 3 but shows the respirator of FIG. 10.
Figure 12:
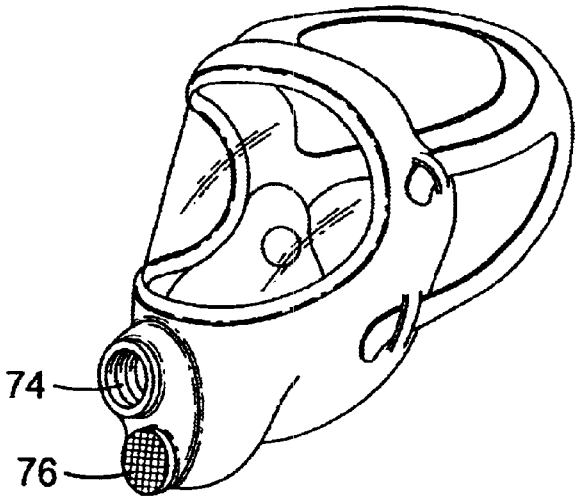
FIGS. 12 to 14 are perspective views of other forms of respirator in accordance with the invention.
Figure 13:
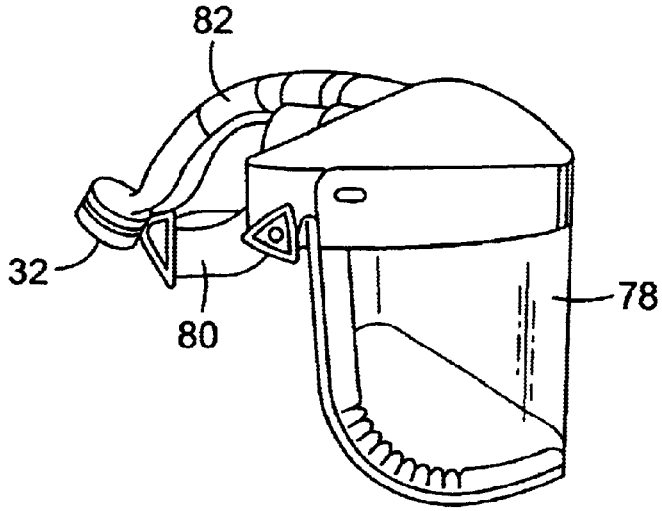

FIGS. 10 and 11, for example, show a head piece comprising a visor 70 and a loose fitting hood 72, at the rear of which is a venturi device 32 of the type shown in FIGS. 5 to 8. FIG. 12 shows a face mask that is intended to cover the eyes as well as the nose and mouth of the wearer, with the air inlet 74, and also an outlet valve 76, provided at the front of the mask. In this case, the flow-detecting venturi device could be located in the air inlet 74 and connected to an indicator device positioned inside the mask in the field of view of the wearer. FIG. 13 shows a head piece comprising a visor 78 and a head harness 80, and an air duct 82 extending over the top of the wearer's head to carry a forced flow of air to the inside of the visor. In this case, the venturi device 32 is located in the inlet of the air duct 82 and is connected, through a tube located within the air duct, to an indicator device within the visor in the field of view of the wearer.

Figure 14:
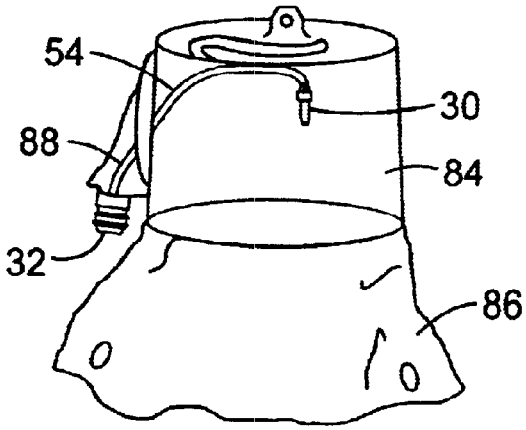

FIG. 14 shows yet another head piece comprising a generally cylindrical head enclosure 84 formed from a transparent material and provided with a cape 86 for covering the upper part of the body of the wearer. The head piece has a supply pipe 88 for carrying a forced flow of air to the interior of the head enclosure 84, the inlet of which is provided with a venturi device 32 connected via a tube 54 to an indicator device 30.

In each of the respirators shown in FIGS. 10 to 14, the external shape of the venturi device 32 (especially towards the outlet end 38, see FIG. 5) is adapted to suit the particular form of the head piece.

As a further alternative, the indicator device 30 and flow-detecting venturi device 32 may be used in a so-called supplied air respirator system in which the forced flow of air into the respirator headpiece is provided by a source of compressed air, which may be either fixed or portable.

All patents cited above, including the patents cited in the Background, are incorporated by reference into this patent application as if reproduced in total.

The invention also may be suitably practiced in the absence of any element not specifically disclosed herein.

As indicated, this invention may take on various modifications and alterations without departing from the spirit and scope thereof Accordingly, it is to be understood that this invention is not to be limited to the above-described, but it is to be controlled by the limitations set forth in the following claims and any equivalents thereof.

What is claimed is:

1. A respirator that is capable of directing a forced flow of filtered air to a wearer, the respirator comprising:

a head piece that is adapted to form a breathing zone around at least the nose and mouth of the wearer, an air flow passage through which a forced flow of filtered air passes before entering the breathing zone, the passage having a constricted portion containing a flow detecting orifice such that the forced flow of air generates suction at the flow-detecting orifice, the degree of suction being related to the air flow rate in the passage; and a pressure-responsive indicator device that is in fluid communication with the flow-detecting orifice and operable to alert the wearer if the suction generated by the air flow through the passage falls below a predetermined value.

2. The respirator of claim 1, in which the indicator device is positioned within the breathing zone.

3. The respirator of claim 1, in which the indicator device is responsive to the pressure differential between the breathing zone and the flow-detecting orifice.

4. The respirator of claim 1, in which the indicator device comprises a tube in which a float is located, the tube being connected at one end to the flow-detecting orifice and being open at the other end, such that the position of the float indicates the air flow rate in the air flow passage.

5. The respirator of claim 1, in which the constricted portion of the air flow passage comprises a primary venturi; and an auxiliary venturi is positioned within the primary venturi to receive part of the air flowing therethrough; the flow-detecting orifice being located within the auxiliary venturi.

6. The respirator of claim 5, in which the auxiliary venturi is coaxial with the primary venturi.

7. The respirator of claim 5, in which the outlet of the auxiliary venturi is positioned in the throat of the primary venturi.

8. The respirator of claim 1, in which the head piece provides a breathing zone which also covers the eyes and at least part of the top, back and sides of the wearer's head.

9. The respirator of claim 1, in which the constricted portion of the air flow passage is located on the head piece.

10. The respirator of claim 1, further comprising a source of pressurised filtered air connected to the air flow passage.

11. The respirator of claim 10, in which the source of pressurised filtered air comprises a fan and air filtering means; the fan being operable to direct ambient air through the filtering means and to direct filtered air to the breathing zone.

* * * * *

UNITED STATES PATENT AND TRADEMARK OFFICE

CERTIFICATE OF CORRECTION

PATENT NO. : 6,615,828 B1
DATED : September 9, 2003
INVENTOR(S) : Petherbridge, Ian T.

It is certified that error appears in the above-identified patent and that said Letters Patent is hereby corrected as shown below:

Column 2,
Line 49, delete “respirator” and replace with -- respirators --.

Column 4,
Line 13, insert -- it -- following “when”.
Line 65, delete “use” and replace with -- used --.

Column 5,
Line 13, before “length” start a new paragraph.
Line 49, delete “respirator” and replace with -- respirators --.

Column 6,
Line 44, following “thereof”, insert -- . --.

Column 8,
Lines 10 and 12, delete “pressurised” and replace with -- pressurized --.

Signed and Sealed this

Seventeenth Day of February, 2004

JON W. DUDAS
*Acting Director of the United States Patent and Trademark Office*